US011834260B1

(12) United States Patent
Guezo

(10) Patent No.: US 11,834,260 B1
(45) Date of Patent: Dec. 5, 2023

(54) INTERNAL LIFT EQUIPPED REFUSE RECEPTACLE ASSEMBLY

(71) Applicant: Desire Guezo, Bronx, NY (US)

(72) Inventor: Desire Guezo, Bronx, NY (US)

( * ) Notice: Subject to any disclaimer, the term of this patent is extended or adjusted under 35 U.S.C. 154(b) by 0 days.

(21) Appl. No.: 17/860,662

(22) Filed: Jul. 8, 2022

(51) Int. Cl.
*B65F 1/06* (2006.01)
*B65F 1/14* (2006.01)

(52) U.S. Cl.
CPC ..... *B65F 1/068* (2013.01); *B65F 1/1452* (2013.01); *B65F 1/1473* (2013.01)

(58) Field of Classification Search
CPC ..... B65F 1/068; B65F 1/1452; B65F 1/1473
USPC ..... 220/495.04
See application file for complete search history.

(56) References Cited

U.S. PATENT DOCUMENTS 5,361,978 A * 11/1994 Monroe ..... B65F 1/1473 220/908
5,373,732 A 12/1994 Bowers
5,388,717 A 2/1995 LaVasseur
6,102,343 A 8/2000 Grimesey
7,273,155 B1 * 9/2007 Gray ..... B65F 1/065 220/8
10,464,747 B2 * 11/2019 Abang, Jr. ..... B65F 1/1415
2011/0272407 A1 * 11/2011 Golcheh ..... B65F 1/163 220/263
2012/0312828 A1 12/2012 Herndon

FOREIGN PATENT DOCUMENTS

CN 108773601 A * 11/2018
CN 114379956 A * 4/2022
FR 299162 A1 * 2/2014
KR 20190096064 A * 8/2019
KR 20200038918 A * 4/2020
WO WO2011071464 6/2011

* cited by examiner

*Primary Examiner* — J. Gregory Pickett
*Assistant Examiner* — Niki M Eloshway

(57) ABSTRACT

An internal lift equipped refuse receptacle assembly for facilitating removal of full or partially full trash can liners includes a tubular housing and a false bottom. The tubular housing has a true bottom and a top. The true bottom is closed. The top is open for insertion of a trash can liner into the tubular housing. The false bottom is operationally engaged to an actuator, which is engaged to the tubular housing. A controller is engaged to the tubular housing so that the controller is accessible to a user. The controller is operationally engaged to the actuator and can be selectively manipulated by the user to activate the actuator to motivate the false bottom, the trash can liner, and contents of the trash can liner from proximate to the true bottom toward the top, facilitating removal of the trash can liner and its contents from the tubular housing.

13 Claims, 6 Drawing Sheets

INTERNAL LIFT EQUIPPED REFUSE RECEPTACLE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to refuse receptacles and more particularly pertains to a new refuse receptacle for facilitating removal of full or partially full trash can liners. The present invention discloses a refuse receptacle having a false bottom which is vertically adjustable by depressing a pedal to activate a telescopic cylinder to raise the false bottom.

(2) Description of Related Art Including Information Disclosed Under 37 CFR 1.97 and 1.98

The prior art relates to refuse receptacles. Prior art refuse receptacles may comprise pedals attached to levers, which when pressed down upon raise false bottoms within refuse receptacles. The extent to which the false bottom is raised is restricted to a degree of motion of a load end of the lever relative to a fulcrum. What is lacking in the prior art is a refuse receptacle having a false bottom which is vertically adjustable by depressing a pedal to activate a telescopic cylinder to raise the false bottom.

BRIEF SUMMARY OF THE INVENTION

An embodiment of the disclosure meets the needs presented above by generally comprising a tubular housing and a false bottom. The tubular housing has a true bottom and a top. The true bottom is closed. The top is open and thus is configured for insertion of a trash can liner into the tubular housing. The false bottom is sized and shaped complementarily to the true bottom. The false bottom is operationally engaged to an actuator, which is engaged to the tubular housing. The actuator is positioned to selectively motivate the false bottom from proximate to the true bottom toward the top of the tubular housing. A controller is engaged to the tubular housing so that the controller is accessible to a user. The controller is operationally engaged to the actuator and is configured to be selectively manipulated by the user to activate the actuator to motivate the false bottom, the trash can liner, and contents of the trash can liner from proximate to the true bottom toward the top, facilitating removal of the trash can liner and its contents from the tubular housing.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
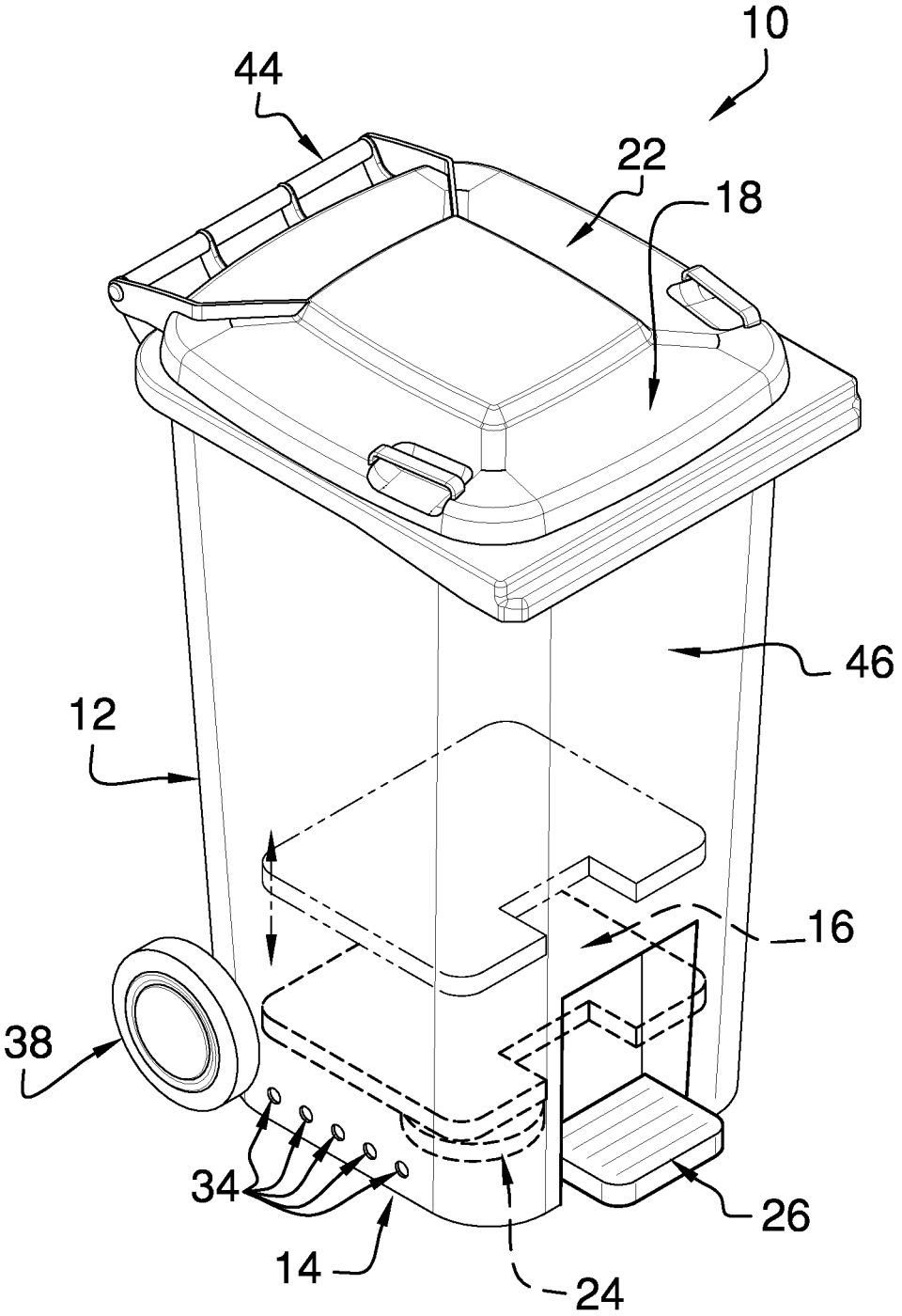
FIG. 1 is an isometric perspective view of an internal lift equipped refuse receptacle assembly according to an embodiment of the disclosure.

With reference now to the drawings, and in particular to FIGS. 1 through 6 thereof, a new refuse receptacle embodying the principles and concepts of an embodiment of the disclosure and generally designated by the reference numeral 10 will be described.

As best illustrated in FIGS. 1 through 6, the internal lift equipped refuse receptacle assembly 10 generally comprises a tubular housing 12 and a false bottom 16. The tubular housing 12 has a true bottom 14 and a top 18. The tubular housing 12 may be substantially cuboid shaped, as shown in FIG. 1, although the present invention anticipates the tubular housing 12 being alternatively shaped, such as, but not limited to, cylindrically shaped and the like.

Figure 3:
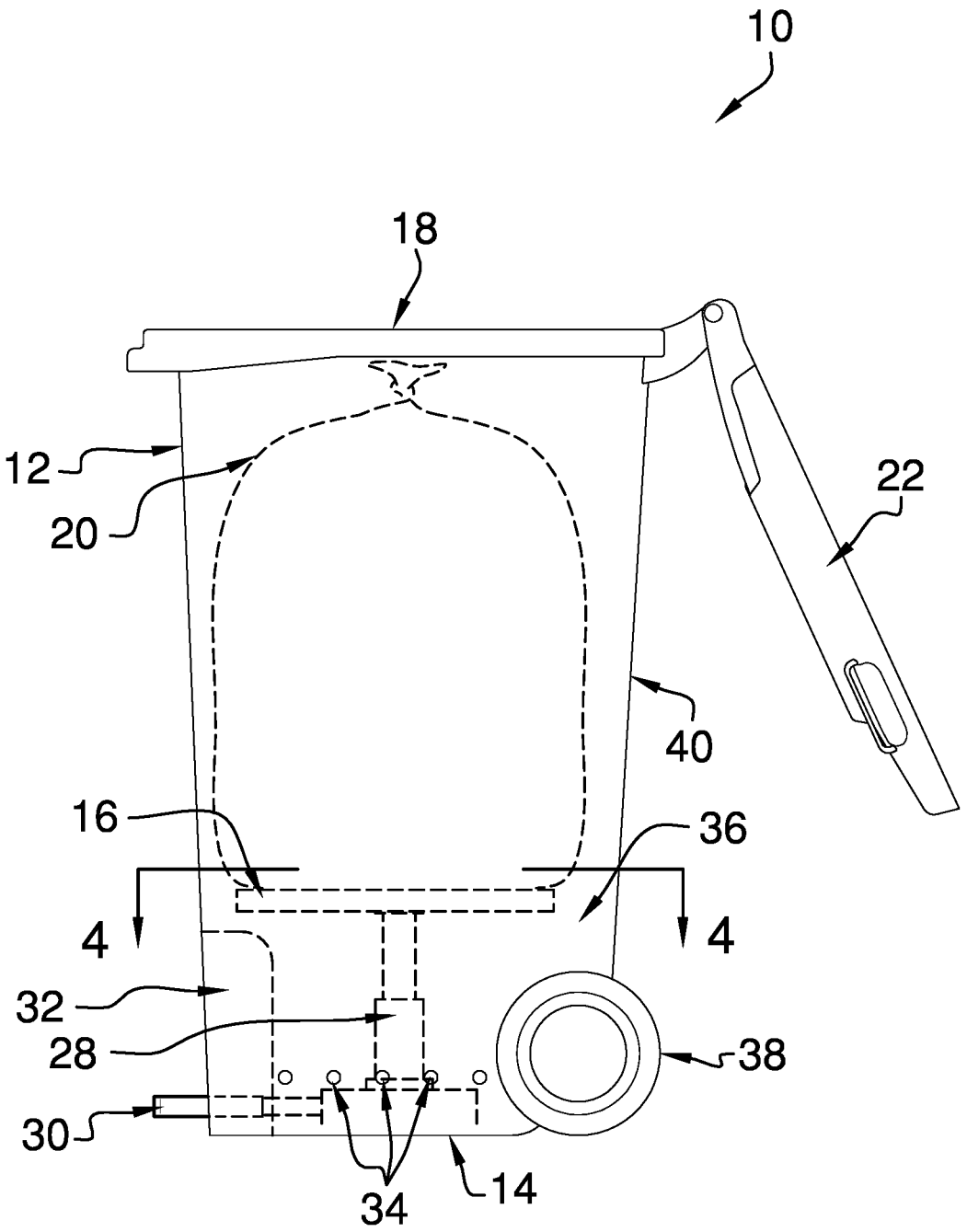
FIG. 3 is an in-use view of an embodiment of the disclosure.
Figure 4:
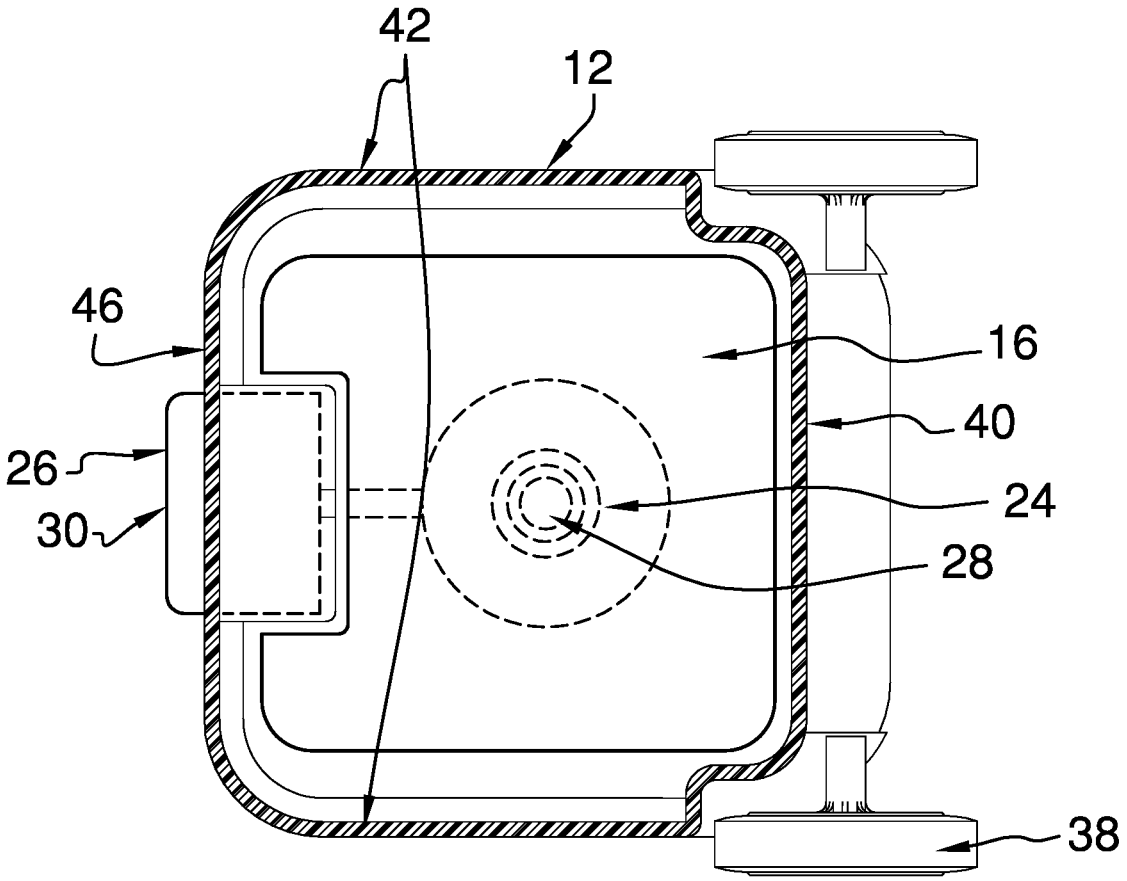
FIG. 4 is a cross-sectional view of an embodiment of the disclosure.
Figure 5:
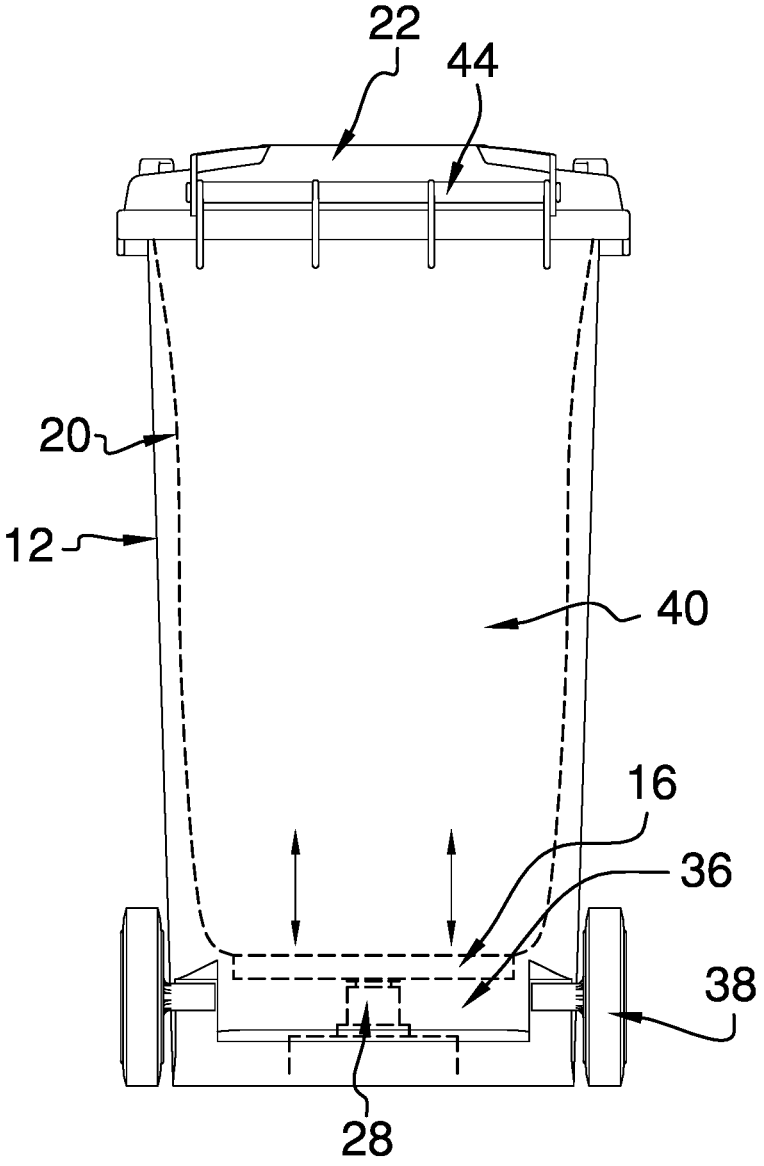
FIG. 5 is a rear view of an embodiment of the disclosure.
Figure 6:
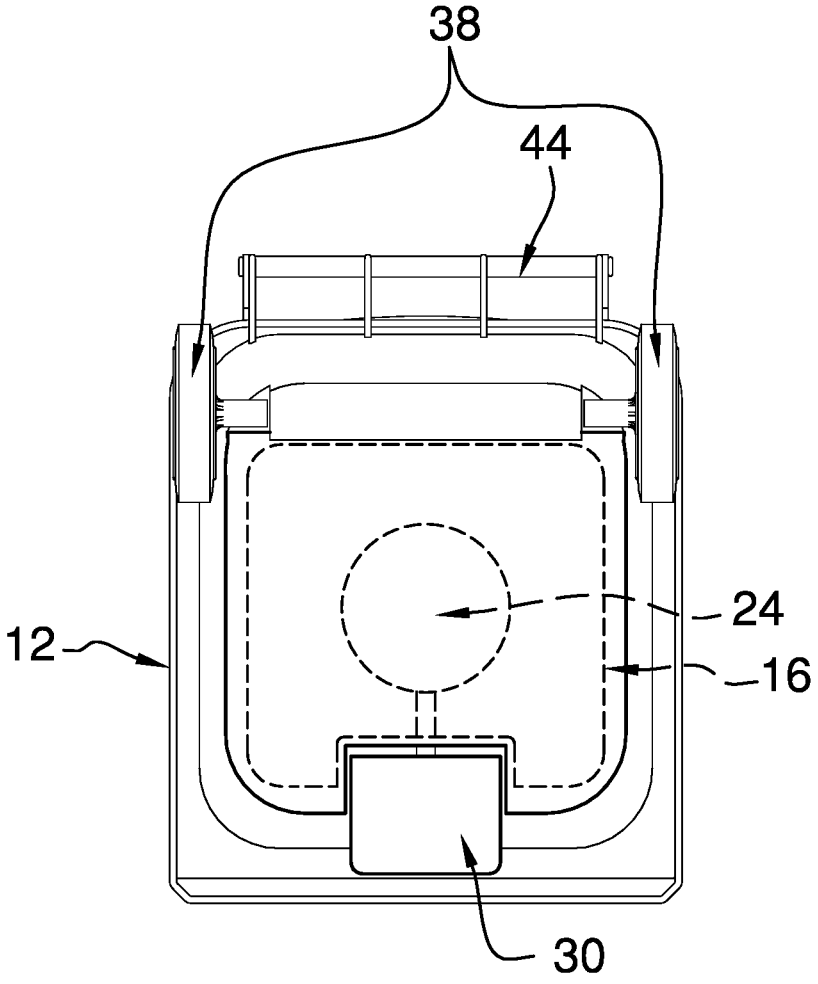
FIG. 6 is a bottom view of an embodiment of the disclosure.

The true bottom 14 is closed. The top 18 is open and thus is configured for insertion of a trash can liner 20 into the tubular housing 12. The internal lift equipped refuse receptacle assembly 10 also may comprise a lid 22, which is engaged to or selectively engageable to the tubular housing 12 to close the top 18. The lid 22 may be hingedly engaged to the tubular housing 12, as shown in FIG. 3.

The false bottom 16 is sized and shaped complementarily to the true bottom 14. The false bottom 16 is operationally engaged to an actuator 24, which is engaged to the tubular housing 12. The actuator 24 is positioned to selectively motivate the false bottom 16 from proximate to the true bottom 14 toward the top 18 of the tubular housing 12.

A controller 26 is engaged to the tubular housing 12 so that the controller 26 is accessible to a user. The controller 26 is operationally engaged to the actuator 24 and is configured to be selectively manipulated by the user to activate the actuator 24 to motivate the false bottom 16, the trash can liner 20, and contents of the trash can liner 20 from proximate to the true bottom 14 toward the top 18, facilitating removal of the trash can liner 20 and its contents from the tubular housing 12.

Figure 2:
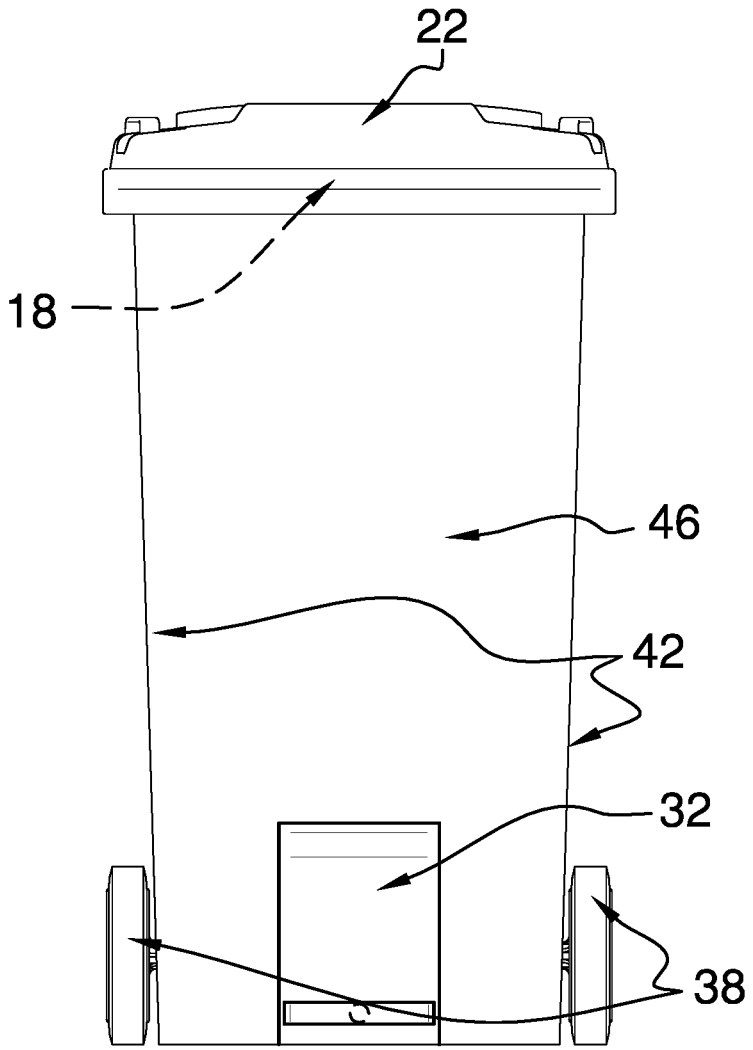
FIG. 2 is a front view of an embodiment of the disclosure.

The actuator 24 may comprise a telescopic cylinder 28, which is engaged to and extends between the true bottom 14 and the false bottom 16, or other actuating means, such as, but not limited to, scissor lifts, racks and pinions, bottle jacks, inflatable jacks, and the like. In this configuration, the controller 26 comprises a pedal 30, which is hingedly engaged to the tubular housing 12. The pedal 30 is configured to be repeatedly depressed by a foot of the user to extend the telescopic cylinder 28. As shown in FIG. 2, a recess 32 extends into a front 46 of the housing proximate to the true bottom 14. The pedal 30 is at least partially positioned in the recess 32.

The present invention also anticipated the telescopic cylinder 28 being hydraulically or pneumatically actuated, in which case the pedal 30 would act to switch the telescopic cylinder 28 on and off.

A plurality of apertures 34 may be positioned in the tubular housing 12, as shown in FIGS. 1 and 3. The apertures 34 are positioned in or proximate to the true bottom 14 and are configured to vent a space 36 between the true bottom 14 and the trash can liner positioned on the false bottom 16. Without venting, the trash can liner 20 may be more difficult to lift as a partial vacuum can be generated in the space 36. Other methods of venting the space 36 are anticipated by the present invention, such as, but not limited to, tubes extending from this space 36 to proximate to the top 18 of the tubular housing 12.

A pair of wheels 38 is engaged to the tubular housing 12 and is positioned proximate to the true bottom 14 and a back 40 of the tubular housing 12. Each wheel 38 is positioned proximate to a respective opposed side 42 of the tubular housing 12. A handle 44 is engaged to the back 40 of the tubular housing 12 and is positioned proximate to the top 18. The handle 44 is configured to be grasped in a hand of the user, positioning the user to tilt the tubular housing 12 so that a center of mass of the tubular housing 12, and its contents, is positioned substantially above the pair of wheels 38. The user thus is positioned to locomote the tubular housing 12 and its contents upon the wheels 38.

In use, a trash can liner 20 is engaged to and positioned in the tubular housing 12. The internal lift equipped refuse receptacle assembly 10 then is utilized as per usual to collect rubbish, recyclables, and the like. When removal of the trash can liner 20 is desired, the pedal 30 is repeatedly depressed to extend the telescopic cylinder 28, thus raising the false bottom 16, the trash can liner 20, and contents of the trash can liner 20.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An internal lift equipped refuse receptacle assembly comprising:

a tubular housing having a true bottom and a top, the true bottom being closed, the top being open, wherein the top is configured for insertion of a trash can liner into the tubular housing;

an actuator engaged to the tubular housing;

a false bottom sized and shaped complementarily to the true bottom, the false bottom being operationally engaged to the actuator, such that the actuator is positioned for selectively motivating the false bottom from proximate to the true bottom toward the top of the tubular housing; and a controller engaged to the tubular housing, such that the controller is accessible to a user, the controller being operationally engaged to the actuator, wherein the controller is configured for being selectively manipulated by the user for activating the actuator for motivating the false bottom, the trash can liner, and contents of the trash can liner from proximate to the true bottom toward the top, facilitating removal of the trash can liner and its contents from the tubular housing;

wherein the actuator comprising a telescopic cylinder engaged to and extending between the true bottom and the false bottom;

wherein the controller comprising a pedal hingedly engaged to the tubular housing, wherein the pedal is configured for repeatedly depressing by a foot of the user for extending the telescopic cylinder; and a recess extending into the front of the housing proximate to and extending upwardly away from the true bottom such that the recess is vertically elongated, the pedal being at least partially positioned in the recess proximate to said true bottom wherein said recess extends upwardly away from said pedal.

2. The internal lift equipped refuse receptacle assembly of claim 1, wherein the tubular housing is substantially rectangular cuboid shaped.

3. The internal lift equipped refuse receptacle assembly of claim 1, further including a lid engaged to or selectively engageable to the tubular housing for closing the top.

4. The internal lift equipped refuse receptacle assembly of claim 3, wherein the lid is hingedly engaged to the tubular housing.

5. The internal lift equipped refuse receptacle assembly of claim 1, further including a plurality of apertures positioned in the tubular housing, the apertures being positioned in or proximate to the true bottom, wherein the apertures are configured for venting a space between the true bottom and the trash can liner positioned on the false bottom.

6. The internal lift equipped refuse receptacle assembly of claim further including:

a pair of wheels engaged to the tubular housing and being positioned proximate the true bottom and a back of the tubular housing, each wheel being positioned proximate to a respective opposed side of the tubular housing; and a handle engaged to the back of the tubular housing and being positioned proximate to the top, wherein the handle is configured for grasping in a hand of the user, positioning the user for tilting the tubular housing such that a center of mass of the tubular housing and its contents is positioned substantially above the pair of wheels, positioning the user for locomoting the tubular housing and its contents upon the wheels.

7. An internal lift equipped refuse receptacle system comprising:

a tubular housing having a true bottom and a top, the true bottom being closed, the top being open;

a trash can liner engaged to and positioned in the tubular housing;

an actuator engaged to the tubular housing;

a false bottom sized and shaped complementarily to the true bottom, the false bottom being operationally engaged to the actuator, such that the actuator is positioned for selectively motivating the false bottom from proximate to the true bottom toward the top of the tubular housing;

a controller engaged to the tubular housing, such that the controller is accessible to a user, the controller being operationally engaged to the actuator, wherein the controller is configured for being selectively manipulated by the user for activating the actuator for motivating the false bottom, the trash can liner, and contents of the trash can liner from proximate to the true bottom toward the top, facilitating removal of the trash can liner and its contents from the tubular housing;

wherein the actuator comprising a telescopic cylinder engaged to and extending between the true bottom and the false bottom;

wherein the controller comprising a pedal hingedly engaged to the tubular housing, wherein the pedal is configured for repeatedly depressing by a foot of the user for extending the telescopic cylinder; and a recess extending into the front of the housing proximate to and extending upwardly away from the true bottom such that the recess is vertically elongated, the pedal being at least partially positioned in the recess proximate to said true bottom wherein said recess extends upwardly away from said pedal.

8. The internal MI equipped refuse receptacle system of claim 7, wherein the tubular housing is substantially rectangular cuboid shaped.

9. The internal lift equipped refuse receptacle system of claim 7, further including a lid engaged to or selectively engageable to the tubular housing for closing the top.

10. The internal lift equipped refuse receptacle system of claim 9, wherein the lid is hingedly engaged to the tubular housing.

11. The internal lift equipped refuse receptacle as system of claim 7, further including a plurality of apertures positioned in the tubular housing, the apertures being positioned in or proximate to the true bottom, wherein the apertures are configured for venting a space between the true bottom and the trash can liner positioned on the false bottom.

12. The internal lift equipped refuse receptacle system of claim 7, further including:

a pair of wheels engaged to the tubular housing and being positioned proximate the true bottom and a back of the tubular housing, each wheel being positioned proximate to a respective opposed side of the tubular housing; and a handle engaged to the back of the tubular housing and being positioned proximate to the top, wherein the handle is configured for grasping in a hand of the user, positioning the user for tilting the tubular housing such that a center of mass of the tubular housing and its contents is positioned substantially above the pair of wheels, positioning the user for locomoting the tubular housing and its contents upon the wheels.

13. An internal lift equipped refuse receptacle assembly comprising:

a tubular housing having a true bottom and a top, the true bottom being closed, the top being open, wherein the top is configured for insertion of a trash can liner into the tubular housing, the tubular housing being substantially rectangular cuboid shaped;

a lid engaged to or selectively engageable to the tubular housing for closing the top, the lid being hingedly engaged to the tubular housing;

an actuator engaged to the tubular housing, the actuator comprising a telescopic cylinder engaged to and extending between the true bottom and the false bottom;

a false bottom sized and shaped complementarily to the true bottom, the Use bottom being operationally engaged to the actuator, such that the actuator is positioned for selectively motivating the false bottom from proximate to the true bottom toward the top of the tubular housing;

a controller engaged to the tubular housing, such that the controller is accessible to a user, the controller being operationally engaged to the actuator, wherein the controller is configured for being selectively manipulated by the user for activating the actuator for motivating the false bottom, the trash can liner, and contents of the trash can liner from proximate to the true bottom toward the top, facilitating removal of the trash can liner and its contents from the tubular housing, the controller comprising a pedal hingedly engaged to the tubular housing, wherein the pedal is configured for repeatedly depressing by a foot of the user for extending the telescopic cylinder;

a plurality of apertures positioned in the tubular housing, the apertures being positioned in or proximate to the true bottom, wherein the apertures are configured for venting a space between the true bottom and the trash can liner positioned on the false bottom;

a recess extending into the front of the housing proximate to and extending upwardly away from the true bottom such that the recess is vertically elongated, the pedal being at least partially positioned in the recess proximate to said true bottom wherein said recess extends upwardly away from said pedal;

a pair of wheels engaged to the tubular housing and being positioned proximate to the true bottom and a back of the tubular housing, each wheel being positioned proximate to a respective opposed side of the tubular housing; and a handle engaged to the back of the tubular housing and being positioned proximate to the top, wherein the handle is configured for grasping in a hand of the user, positioning the user for tilting the tubular housing such that a center of mass of the tubular housing and its contents is positioned substantially above the pair of wheels, positioning the user for locomoting the tubular housing and its contents upon the wheels.

* * * * *